US007301114B2

(12) United States Patent
Sano et al.

(10) Patent No.: US 7,301,114 B2
(45) Date of Patent: Nov. 27, 2007

(54) MOVABLE CONTACT UNIT

(75) Inventors: Yoshiro Sano, Tsuyama (JP); Masahiro Ito, Katsuta-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/039,935

(22) Filed: Jan. 24, 2005

(65) Prior Publication Data

US 2005/0167258 A1 Aug. 4, 2005

(30) Foreign Application Priority Data

Feb. 2, 2004 (JP) ..... 2004-025220
Feb. 2, 2004 (JP) ..... 2004-025221

(51) Int. Cl.
*H01H 13/70* (2006.01)

(52) U.S. Cl. ..... 200/512; 200/5 A

(58) Field of Classification Search ..... 200/512–517, 200/341, 342, 5 A, 310–317; 345/168–173; 341/22

See application file for complete search history.

(56) References Cited

U.S. PATENT DOCUMENTS

| | | | | |
|---|---|---|---|---|
| 4,703,139 | A * | 10/1987 | Dunlap | 200/516 |
| 5,315,204 | A * | 5/1994 | Park | 310/339 |
| 5,871,088 | A * | 2/1999 | Tanabe | 200/514 |
| 5,924,555 | A * | 7/1999 | Sadamori et al. | 200/512 |
| 6,373,008 | B1 * | 4/2002 | Saito et al. | 200/310 |
| 6,595,653 | B2 * | 7/2003 | Saito et al. | 200/314 |
| 6,670,750 | B2 * | 12/2003 | Hanahara et al. | 200/513 |

FOREIGN PATENT DOCUMENTS

JP 2002-216582 8/2002

* cited by examiner

*Primary Examiner*—Elvin Enad
*Assistant Examiner*—Marina Fishman
(74) *Attorney, Agent, or Firm*—Wenderoth, Lind & Ponack, L.L.P.

(57) ABSTRACT

A movable contact unit includes a first movable contact stuck on an adhesive layer beneath a lower face of an insulating film, and a second movable contact placed on the insulating film such that it is overlaid on the first movable contact via the insulating film in between. The movable contact unit has greater repulsive force and is excellent in durability.

23 Claims, 14 Drawing Sheets

MOVABLE CONTACT UNIT

FIELD OF THE INVENTION

The present invention relates to a movable contact unit of a switch to be used in an operating panel of a variety of electronic devices.

BACKGROUND OF THE INVENTION

A movable contact unit formed by bonding a movable contact shaped like a dome onto flexible insulating film is widely used in switches of operating panels of various electronic devices. FIG. 14 shows a sectional view of a conventional movable contact unit. The unit shown in FIG. 14 is enlarged in a thickness direction in order to show the structure more understandably. Adhesive layer 2 is prepared beneath flexible insulating film 1, and plural movable contacts 3 shaped like domes and made of conductive thin metal plates are bonded onto adhesive layer 2, so that plural movable contact units 30 are formed.

A placement of the plural movable contact units is determined depending on each one of the switches of an operating panel. FIG. 15 shows a perspective exploded view of a movable contact unit to be used in a cellular phone. Plural movable contacts 3 or 4 forming plural movable contact units are placed as illustrated.

FIG. 16 shows a sectional view illustrating a conventional switch of an operating panel. A movable contact unit having movable contacts 3 is bonded onto circuit board 7 having fixed contact 6 (contacts 6A, 6B) via adhesive layer 2. A center section of movable contact 3 opposes fixed contact 6A via a space, and a circumference of movable contact 3 is brought into contact with fixed contact 6B. A contact pair including a movable contact 3 and a fixed contact 6 forms an individual switch of the operating panel. Operating button 8 movable up and down is provided on each one of the movable contact units.

When depressing force applied to button 8 exceeds repulsive force of domed movable contact 3, contact 3 bows downward moderately as shown in FIG. 17, then the center section of contact 3 comes into contact with fixed contact 6A, so that fixed contacts 6A and 6B on circuit board 7 are electrically connected to each other via movable contact 3. Removing the depressing force applied to button 8 prompts resilient restoring force of contact 3 to restore button 8 and contact 3 to the original position shown in FIG. 16, so that the electrical connection between fixed contacts 6A and 6B on board 7 is disconnected.

In the movable contact units used in a cellular phone and shown in FIG. 15, the unit having movable contact 4 placed at the center of contacts 5 placed crosswise is used for an "enter" operation. Japanese Patent Application Non-Examined Publication No. 2002-216582 discloses that movable contact 4 has repulsive force greater than movable contacts 3 around contact 4 to prevent a careless "enter" operation. In this case, it is difficult for movable contact 4 to obtain satisfactory durability while contact 4 gets greater repulsive force than movable contacts 3 and maintains the same dimensions as contacts 3.

SUMMARY OF THE INVENTION

The present invention addresses the problem discussed above, and aims to provide a movable contact unit having greater repulsive force as well as superb durability.

The movable contact unit of the present invention comprises the following elements:

an insulating film having an adhesive layer at its lower face;

a first movable and domed contact bonded to the adhesive layer, the contact ready to repel a depression applied thereon; and a second domed movable contact placed on an upper face of the insulating film concentrically with the first movable contact, the second contact ready to repel a depression applied thereon.

The movable contact unit of the present invention has great repulsive force summed of the repulsive force of first and second movable contacts. Each one of the first and second movable contacts has superb durability, so that the movable contact unit of the present invention is also provided with superb durability.

DETAILED DESCRIPTION OF PREFERRED EMBODIMENTS

Exemplary Embodiment 1

The first exemplary embodiment of the present invention is demonstrated hereinafter with reference to accompanying drawings. Similar elements to those described in the background of the invention have the same reference marks, and the detailed descriptions thereof are omitted here.

Figure 1:
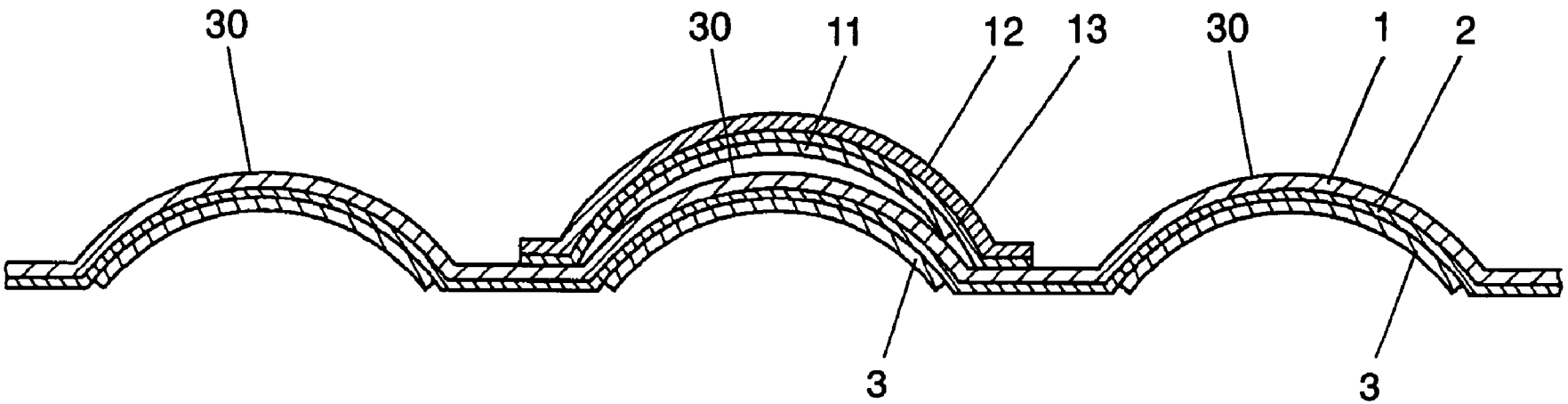
FIG. 1 shows a sectional view of a movable contact unit in accordance with a first exemplary embodiment of the present invention.

FIG. 1 shows a sectional view of a movable contact unit in accordance with the first exemplary embodiment of the present invention. Adhesive layer 2 is prepared beneath flexible insulating film 1, and plural movable contacts 3 shaped like domes and made of conductive thin metal plates are bonded onto adhesive layer 2, so that plural movable contact units 30 are formed.

Figure 2:
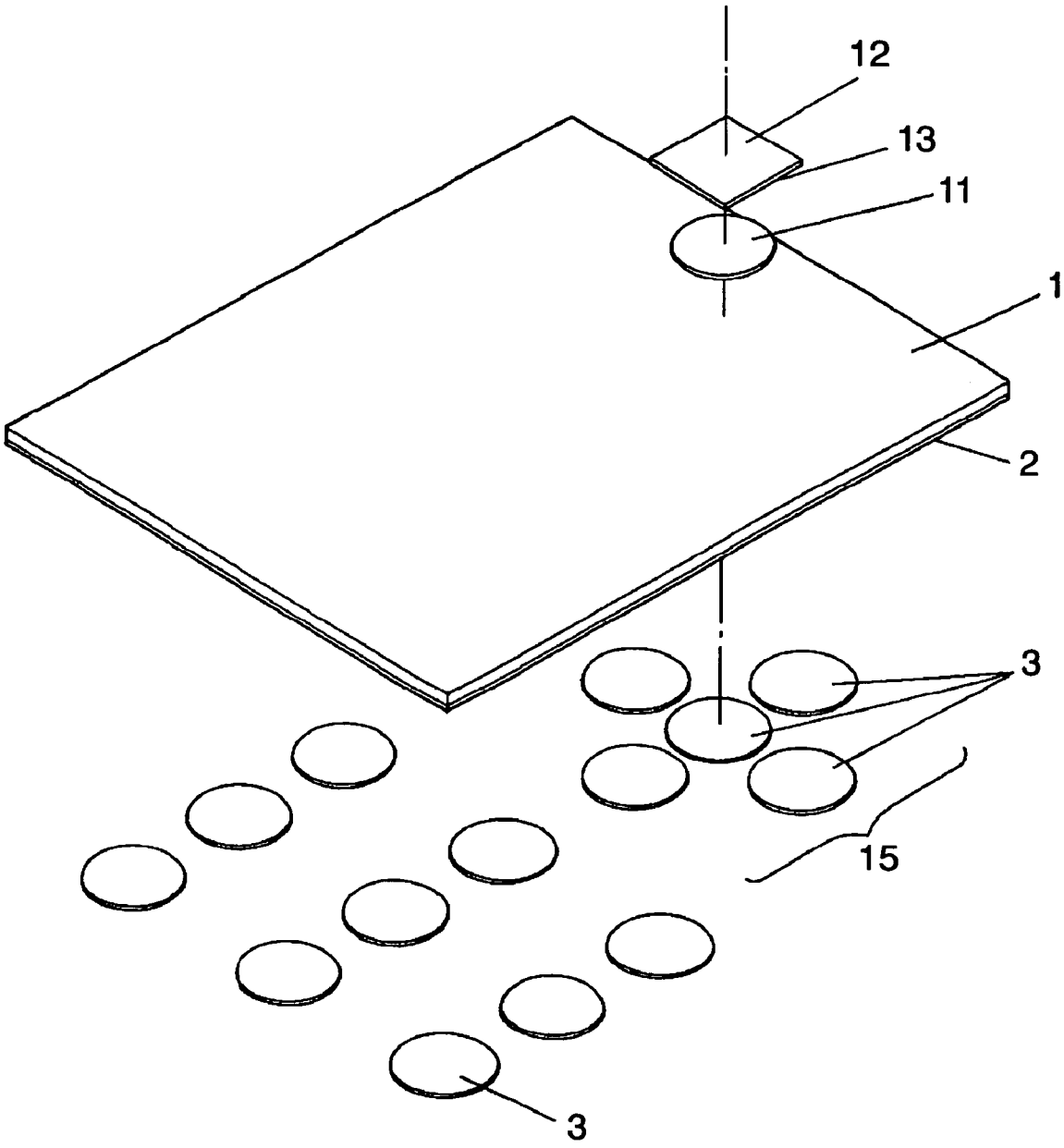
FIG. 2 shows a perspective exploded view of the movable contact unit in accordance with the first exemplary embodiment of the present invention.
Figure 3:
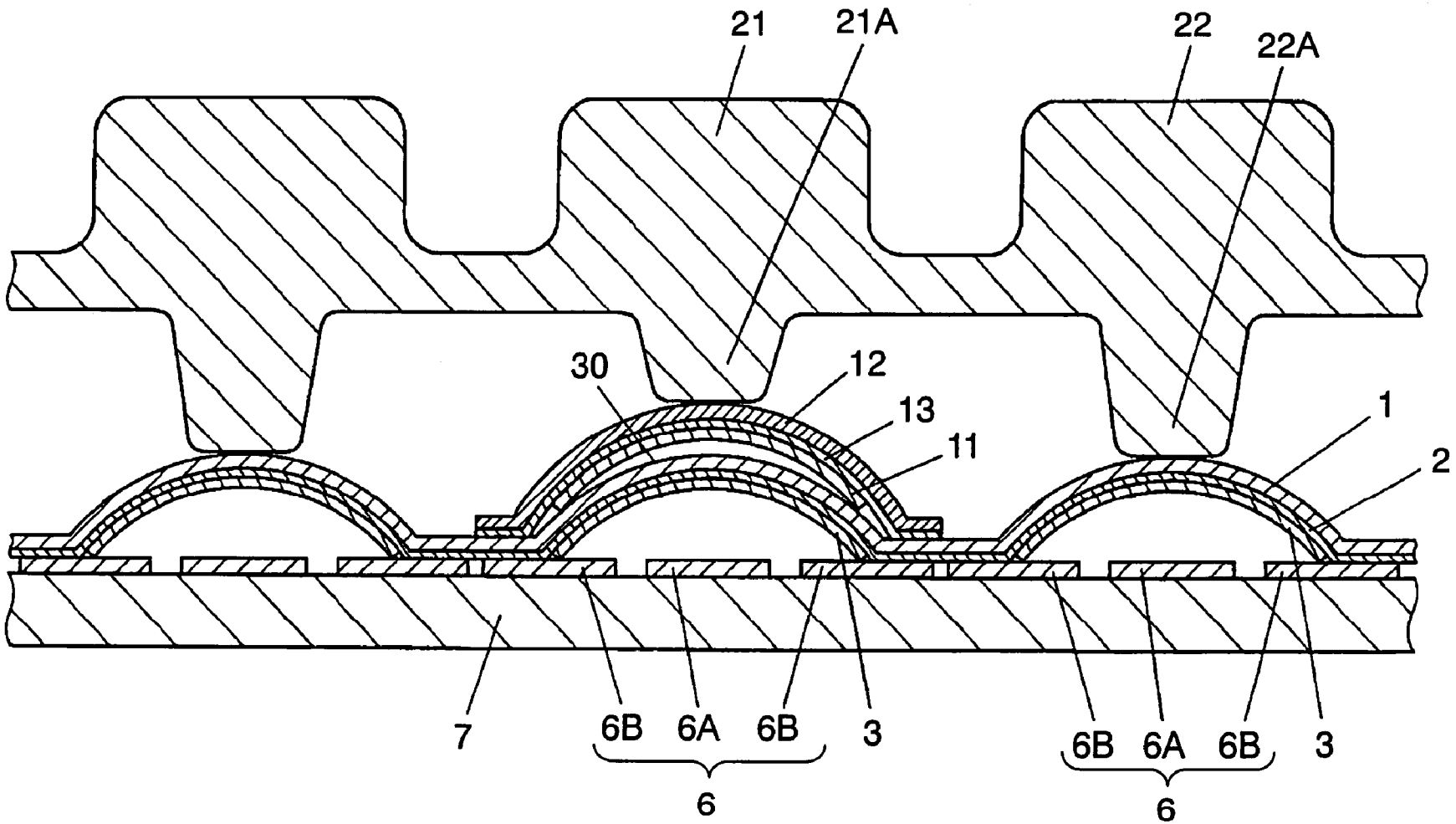
FIG. 3 shows a sectional view illustrating switches, equipped with the movable contact unit shown in FIG. 1, of an operating panel.

As an example, the following case is demonstrated, where those movable contact units are used in a cellular phone. FIG. 2 shows a perspective exploded view of the movable contact units used in a cellular phone. The movable contact unit (the contact unit at the center in FIG. 1) having movable contact 3 placed at the center of cross shape 15 is used for an "enter" operation. The cross shape 15 is formed by a row of movable contacts 3 intersecting with a column of movable contacts 3. As shown in FIGS. 1 and 3, the row of movable contacts 3 includes surrounding movable contacts 3 on opposite sides of the center movable contact 3. The center movable contact unit comprises the following elements:

movable contact 11 placed on movable contact 3 concentrically via insulating film 1; and fixing film 12 having adhesive layer 13 for sticking contact 11 onto insulating film 1.

Movable contact 11 is the same one as movable contact 3.

FIG. 3 shows a sectional view illustrating a switch of an operating panel. Movable contact unit 30 is bonded on circuit board 7 having fixed contact 6 (6A, 6B) via adhesive layer 2. A contact pair including a movable contact 3 and a fixed contact 6 forms an individual switch of the operating panel. This is the same as the conventional one.

Operating buttons 21, 22 movable up and down are placed respectively on each one of the movable contact units, so that the switch of an operating panel is constructed. Button 21 corresponds to the movable contact unit, i.e. the movable contact unit of the present invention, including movable contacts 3 and 11, and button 22 corresponds to a regular movable contact unit including only movable contact 3.

Next, an operation of the foregoing switch of the operating panel is demonstrated hereinafter. Since a regular movable contact unit operates upon depressing button 22 in a similar way to the conventional one, the description thereof is omitted here. An operation of the movable contact unit of the present invention upon depressing button 21 is described here.

When a depressing force applied to operating button 21 exceeds approx. twice the repulsive force of movable contact 3, namely, the sum of repulsive forces of movable contacts 11 and 3, both of movable contacts 11 and 3 bow downward at the same time, so that the center section of movable contact 3 comes into contact with fixed contact 6A in a similar way to the conventional one. As a result, fixed contacts 6A and 6B are electrically connected to each other via movable contact 3. Removal of the depressing force applied to button 21 prompts elastic restoring force of movable contacts 11 and 3 to restore movable contacts 11, 3 and button 21 to their original statuses, so that fixed contact 6A is electrically disconnected from fixed contact 6B.

As discussed above, the movable contact unit of the present invention formed by overlaying movable contact 11 on movable contact 3 can produce approx. twice as much repulsive force as the regular movable contact unit formed of only movable contact 3. Since movable contacts 11 and 3 are the same, the movable contact unit of the present invention has durability similar to that of the regular movable contact unit.

Transparent or semi-transparent insulating film is desirably used as both of insulating film 1 and fixing film 12 because both of the movable contacts can be seen in the assembling line, so that they can be assembled concentrically with ease. Insulating film made of polyethyleneterephthalate fits both of insulating film 1 and fixing film 12. A thickness of the film falling within 12.5-25 μm gives fixing film 12 better operating tactile impression.

Exemplary Embodiment 2

The second exemplary embodiment of the present invention is demonstrated hereinafter with reference to accompanying drawings. Similar elements to those described in the background of the invention have the same reference marks, and the detailed descriptions thereof are omitted here.

Figure 4:
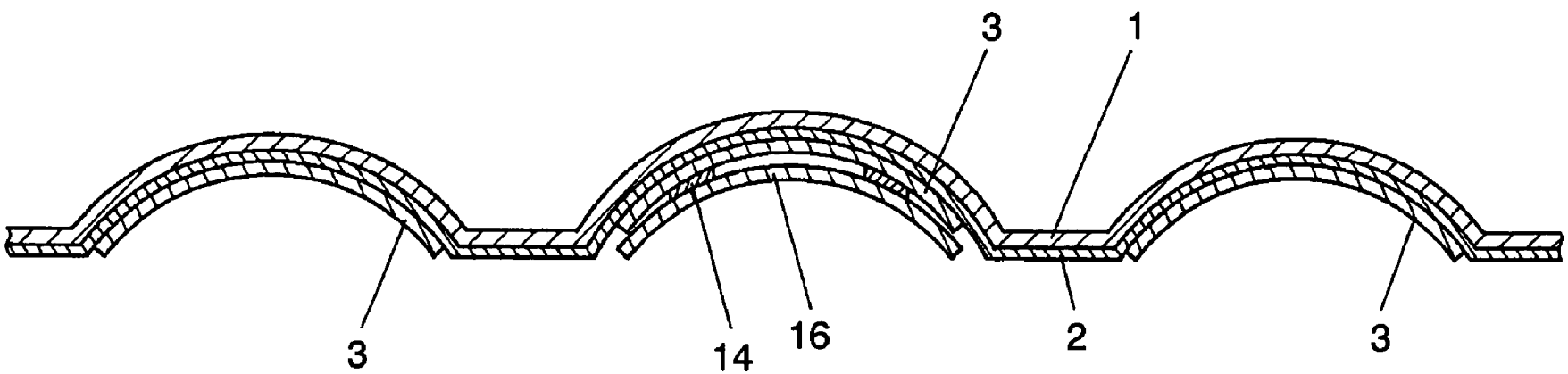
FIG. 4 shows a sectional view of a movable contact unit in accordance with a second exemplary embodiment of the present invention.

FIG. 4 shows a sectional view of a movable contact unit in accordance with the second exemplary embodiment of the present invention. Adhesive layer 2 is prepared beneath flexible insulating film 1, and plural movable contacts 3 shaped like domes and made of conductive thin metal plates are bonded onto adhesive layer 2, so that plural movable contact units are formed.

Figure 5:
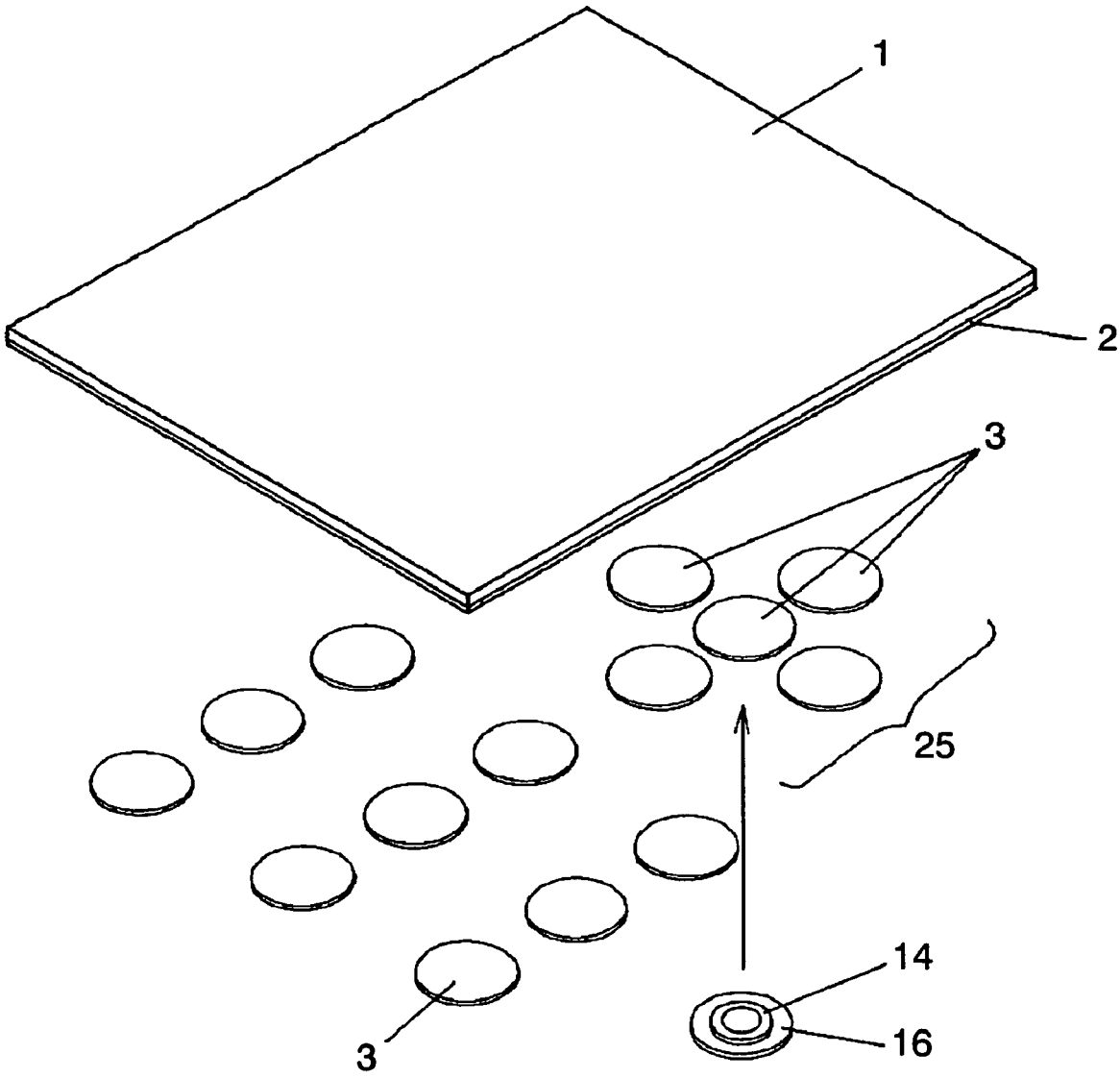
FIG. 5 shows a ring-shaped adhesive layer.

As discussed in the first embodiment, repulsive force of the movable contact unit (the center movable contact unit) for the "enter" operation is desirably greater. To achieve this desire, movable contact 16 shown in FIG. 5 is bonded to the lower face of movable contact 3 concentrically via ring-shaped adhesive layer 13. As a result, the repulsive force of the movable contact unit for the "enter" operation becomes approx. twice that of movable contact 3, namely, the sum of repulsive forces of movable contacts 16 and 3. The movable contact unit for the "enter" operation includes the movable contact 3 that is at the intersection of a row of movable contacts 3 and a column of movable contacts 3 which together form a cross-shape 25, as shown in FIG. 5.

Figure 6:
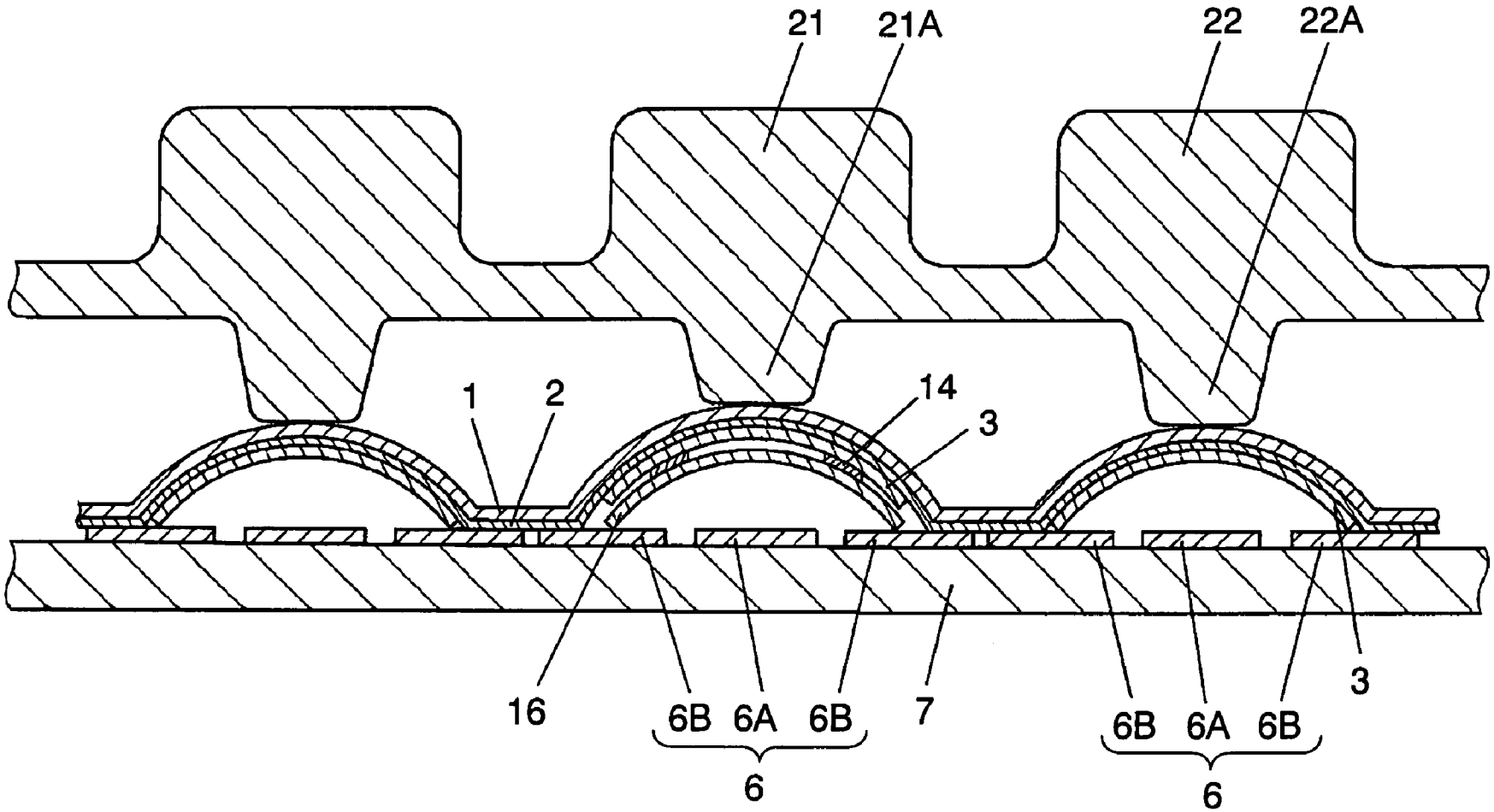
FIG. 6 shows a sectional view of switches, equipped with the movable contact unit shown in FIG. 4, of an operating panel.

FIG. 6 shows a sectional view of switches of an operating panel. The construction and operation of the switches are similar to those demonstrated in the first embodiment (cf. FIG. 3), and the description thereof is thus omitted here.

Adhesive layer 14 preferably employs acrylic adhesive that is excellent in weather resistance to withstand outdoor use. Adhesive layer 14 shaped like a ring is formed on movable contact 16, so that no adhesive layer 14 is present at the center section because large deformation occurs at the center section during the operation. An accident such as peel-off of the adhesive layer at the center section does not happen, so that the switches can operate in a stable manner over a long period.

Figure 7A:
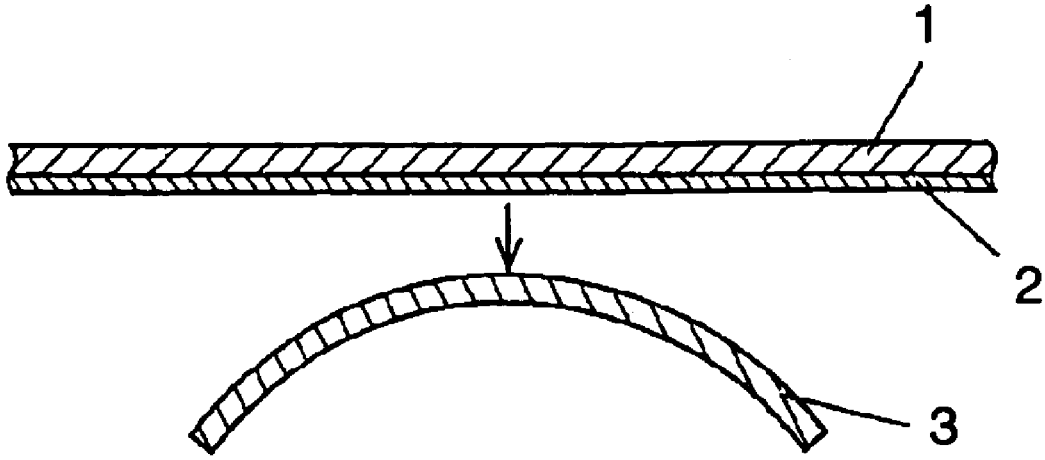
FIG. 7A shows a step of manufacturing the movable contact unit shown in FIG. 4.
Figure 7B:
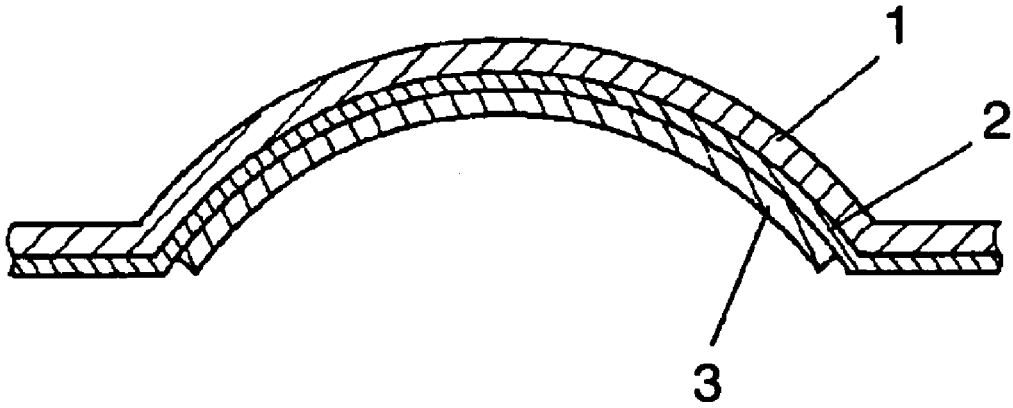
FIG. 7B shows a step of manufacturing the movable contact unit shown in FIG. 4.
Figure 8:
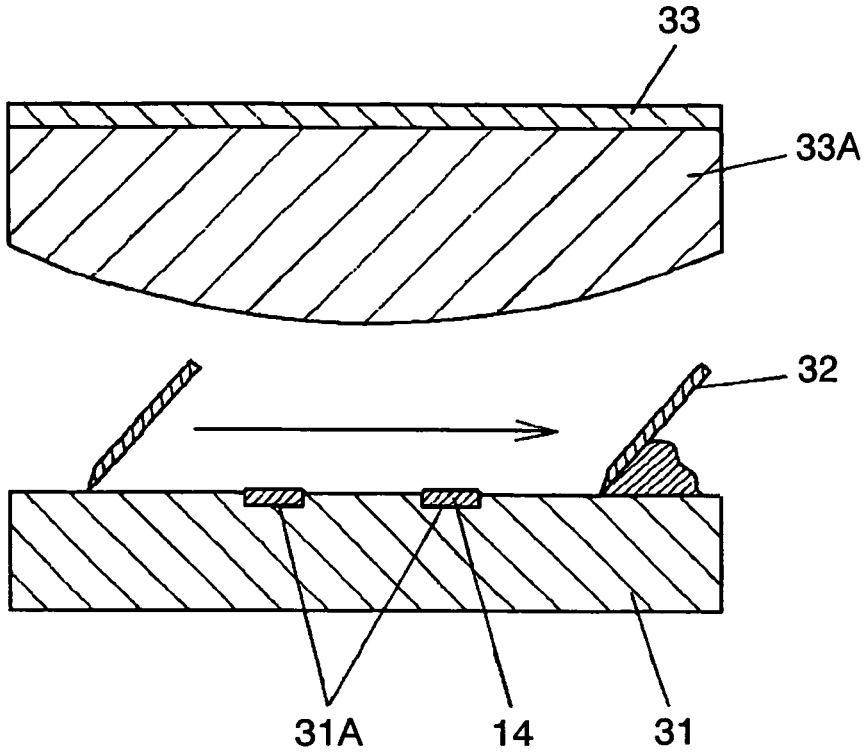
FIG. 8 shows a step of manufacturing the movable contact unit shown in FIG. 4.
Figure 9:
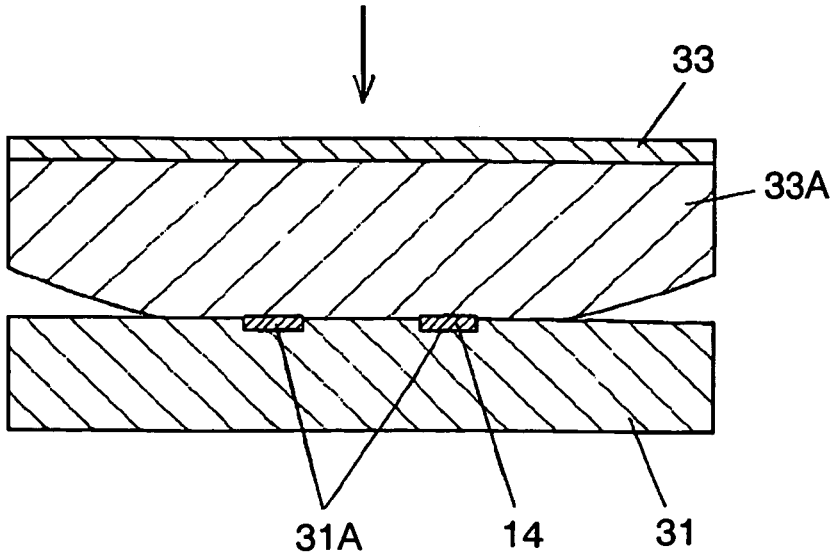
FIG. 9 shows a step of manufacturing the movable contact unit shown in FIG. 4.
Figure 10:
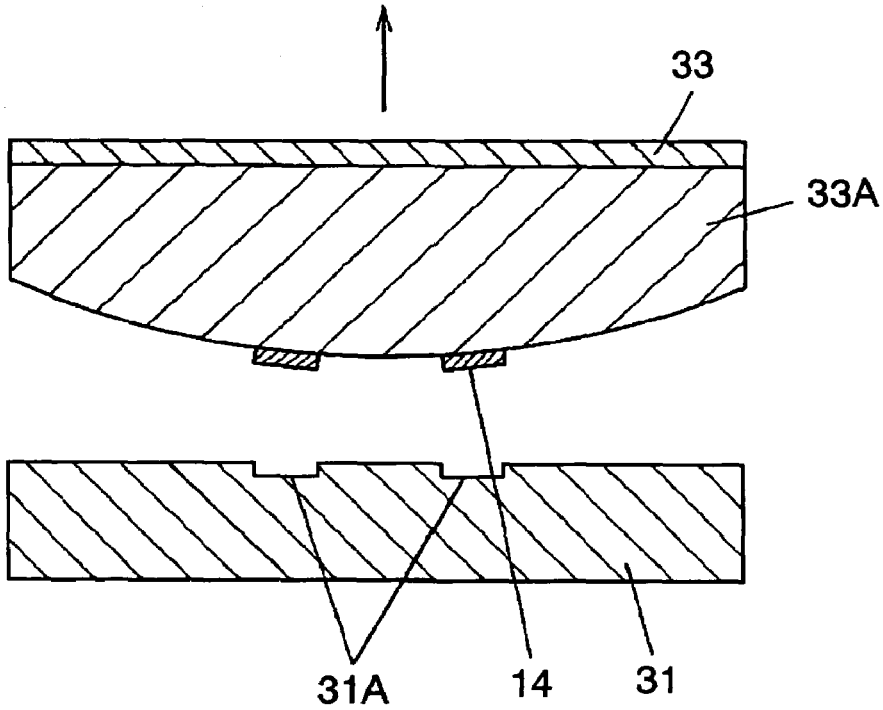
FIG. 10 shows a step of manufacturing the movable contact unit shown in FIG. 4.
Figure 11:
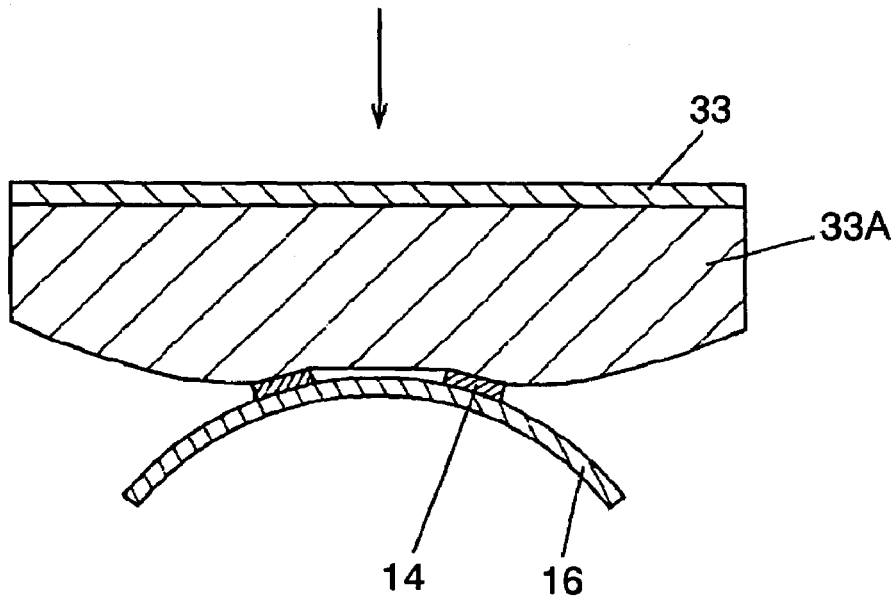
FIG. 11 shows a step of manufacturing the movable contact unit shown in FIG. 4.
Figure 12:
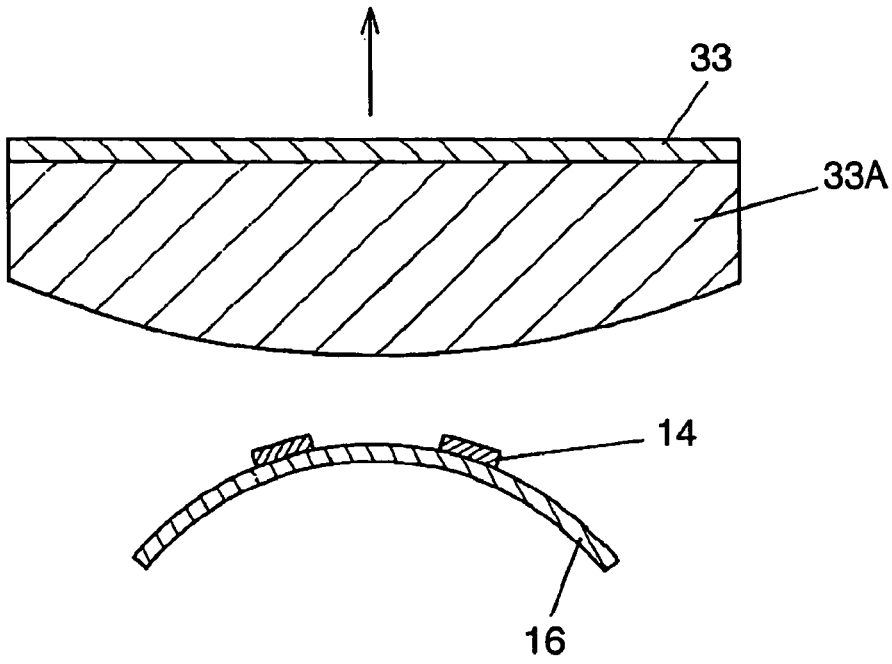
FIG. 12 shows a step of manufacturing the movable contact unit shown in FIG. 4.
Figure 13:
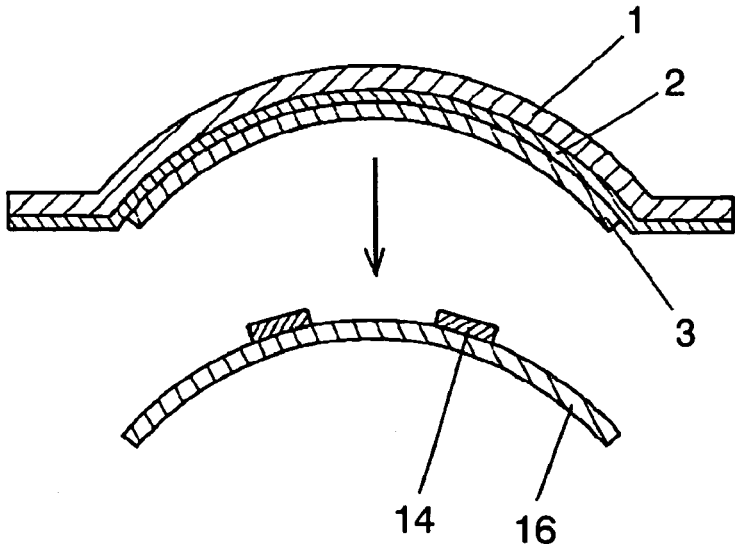
FIG. 13 shows a step of manufacturing the movable contact unit shown in FIG. 4.
Figure 14:
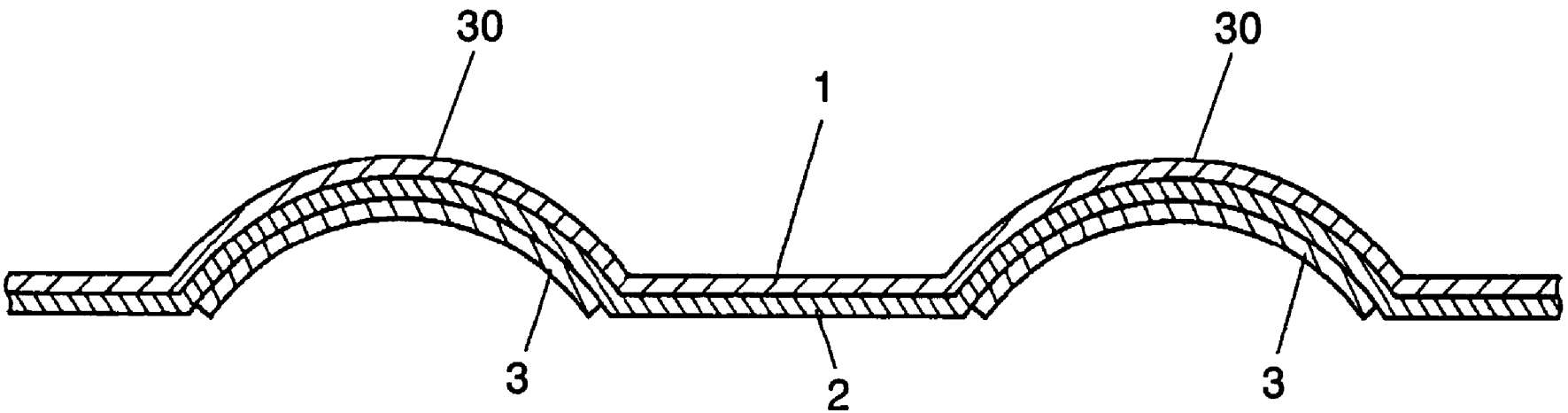
FIG. 14 PRIOR ART
FIG. 14 shows a sectional view illustrating a conventional movable contact unit.
Figure 15:
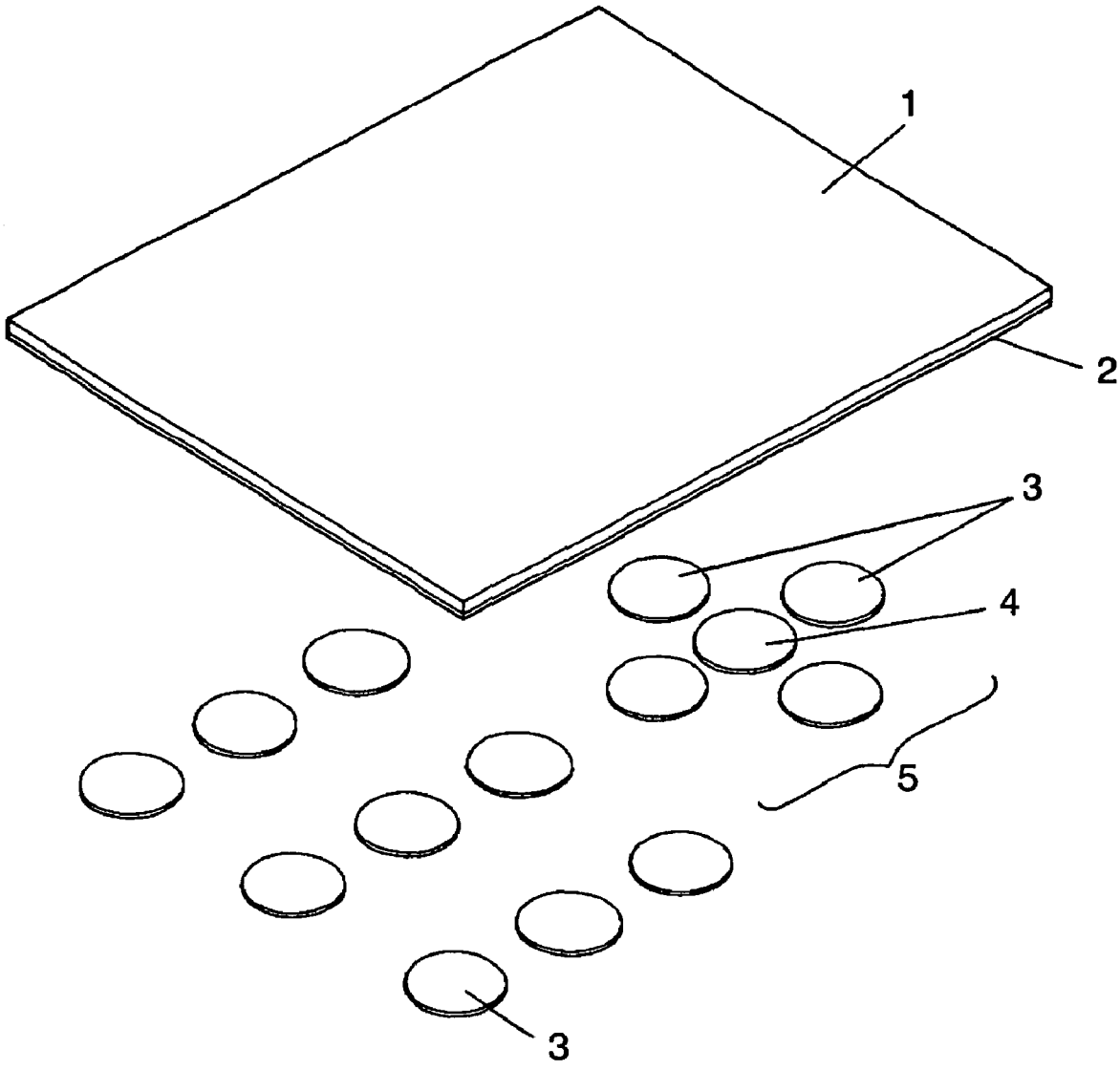
FIG. 15 PRIOR ART
FIG. 15 shows a perspective exploded view of the conventional movable contact unit.
Figure 16:
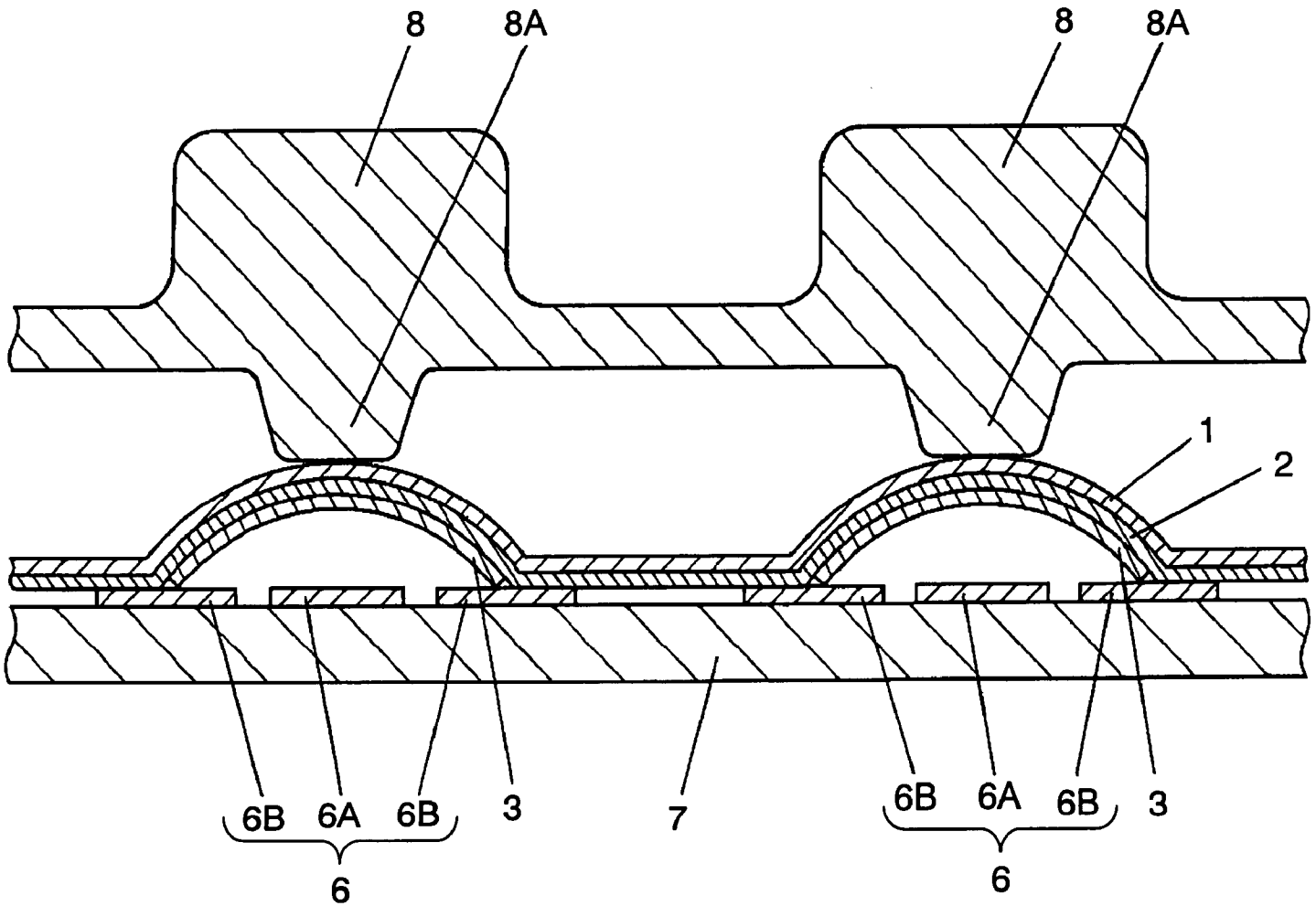
FIG. 16 PRIOR ART
FIG. 16 shows a sectional view of switches, equipped with the movable contact unit shown in FIG. 14, of an operating panel.
Figure 17:
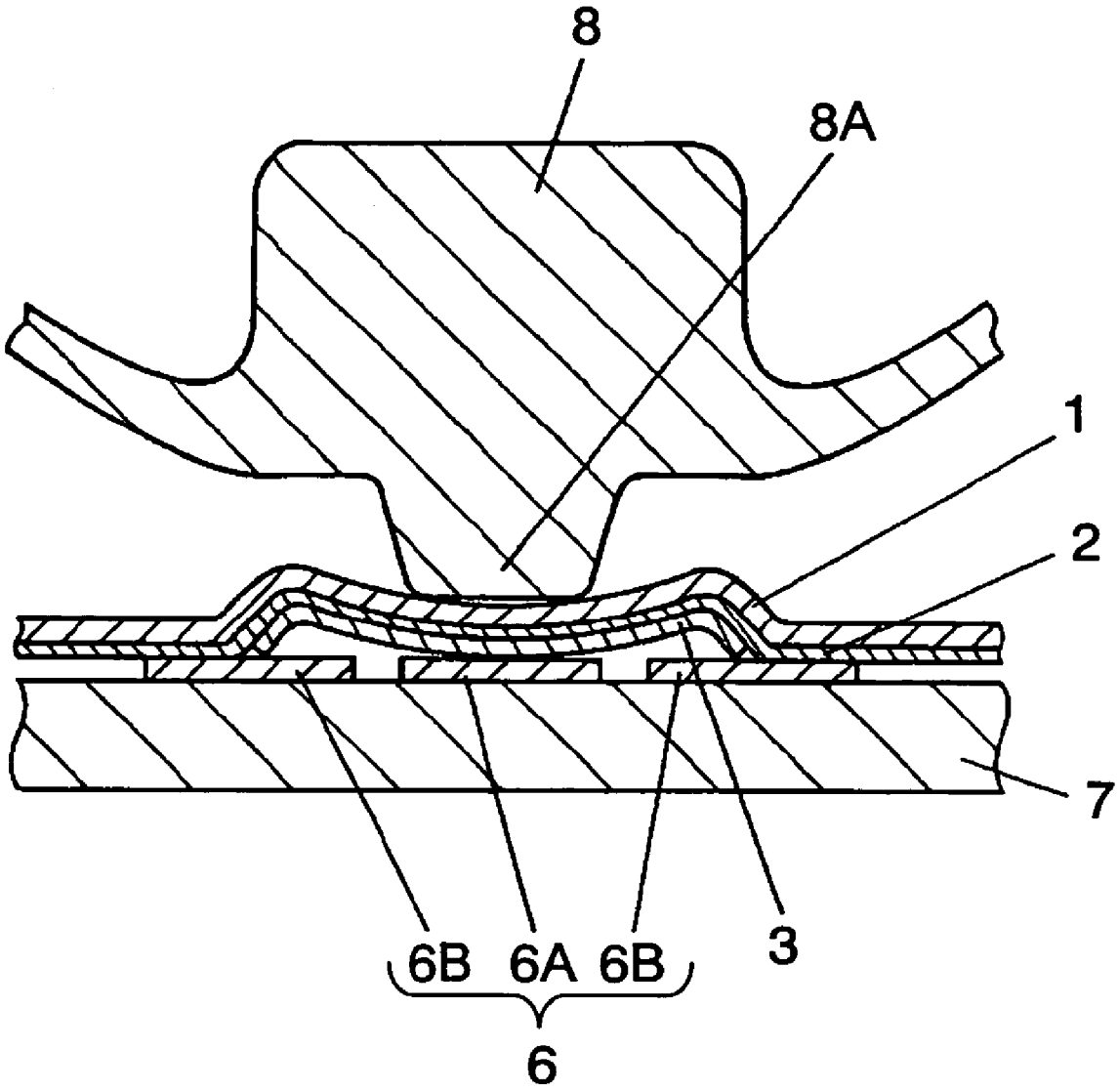
FIG. 17 PRIOR ART
FIG. 17 shows a sectional view illustrating a switch, bowing downwardly or turning inside out, of an operational panel.

A method of manufacturing the movable contact shown in FIG. 4 is demonstrated hereinafter. The manufacturing method includes the following steps:

(a) bonding domed movable contact 3 onto adhesive layer 2 disposed on a lower face of flexible insulating film 1 as shown in FIG. 7A and FIG. 7B;

(b) filling ring-shaped recess 31*a* of die 31 with acrylic-based adhesive 14 by squeegee 32 as shown in FIG. 8, and placing pad 33A made of silicone rubber above die 31;

(c) urging pad 33A against die 31 as shown in FIG. 9, then lifting pad 33A, so that adhesive 14 in recess 31A is transcribed onto pad 33A as shown in FIG. 10;

(d) urging pad 33A against movable contact 16 as shown in FIG. 11, then lifting pad 33A, so that adhesive 14 is transcribed onto movable contact 16 as shown in FIG. 12, thereby obtaining movable contact 16 having ring-shaped adhesive layer 14 at its upper face; and (e) bonding movable contact 3 and movable contact 16 together concentrically via ring-shaped adhesive layer 14 in between as shown in FIG. 13. As a result, the movable contact unit of the present invention is obtained.

What is claimed is:

1. A movable contact arrangement comprising:

a first insulating film, and a first adhesive layer disposed underneath a lower face of said first insulating film;

a plurality of first movable contacts shaped like domes and bonded onto said first adhesive layer and bowing downward upon being depressed, said first movable contacts being positioned so as to be spaced apart from each other and arranged in a cross shape in which a row of said first movable contacts intersects with a column of said first movable contacts;

a second movable contact formed of a conductive thin metal plate, shaped like a dome, and disposed on an upper face of said first insulating film concentrically with one of said first movable contacts and bowing downward upon being depressed so as to depress said one of said first movable contacts to bow downwardly;

a second insulating film, and a second adhesive layer disposed beneath a lower face of said second insulating film, wherein said second movable contact is bonded on said lower face of said second insulating film via said second adhesive layer, and said second insulating film is bonded on said upper face of the first insulating film via said second adhesive layer; and wherein said one of said first movable contacts is positioned at an intersection of said row of said first movable contacts and said column of said first movable contacts so as to be arranged for enter operations wherein said first movable contacts of said row of said first movable contacts include at least a pair of surrounding first movable contacts on opposite sides of said one of said first movable contacts;

wherein said surrounding first movable contacts do not have second movable contacts disposed thereabove that, when depressed, bow downwardly and depress said surrounding first movable contacts, respectively.

2. The movable contact arrangement of claim 1, wherein said first insulating film is one of transparent and semi-transparent.

3. The movable contact arrangement of claim 1, wherein said second insulating film has a thickness not thinner than 12.5 μm and not thicker than 25 μm.

4. The movable contact arrangement of claim 1, wherein each of said first movable contacts is formed of a conductive thin metal plate.

5. The movable contact arrangement of claim 1, wherein said first insulating film and said first adhesive layer extend outwardly beyond a periphery of said one of said first movable contacts.

6. The movable contact arrangement of claim 5, wherein said second insulating film and said second adhesive layer extend outwardly beyond a periphery of said second movable contact.

7. The movable contact arrangement of claim 1, wherein said second insulating film and said second adhesive layer extend outwardly beyond a periphery of said second movable contact.

8. The movable contact arrangement of claim 1, wherein said first insulating film and said first adhesive layer are each of a size so as to cover all of said plurality of said first movable contacts.

9. The movable contact arrangement of claim 1, further comprising operating buttons respectively disposed above said first movable contacts for applying depressing force thereto;

wherein one of said operating buttons is disposed above said one of said movable contacts for applying depressing force thereto;

wherein a surrounding pair of said operating buttons are disposed above said surrounding movable contacts, respectively, for applying depressing force thereto;

wherein said one of said operating buttons is arranged to directly contact said second insulating film; and wherein said surrounding pair of said operating buttons are arranged to directly contact said first insulating film.

10. A movable contact arrangement comprising:

a first insulating film, and a first adhesive layer disposed underneath a lower face of said first insulating film;

a plurality of first movable contacts formed of conductive thin metal plates, shaped like domes, bonded onto said first adhesive layer and bowing downward upon being depressed, said first movable contacts being positioned so as to be spaced apart from each other and arranged in a cross shape in which a row of said first movable contacts intersects with a column of said first movable contacts;

a second movable contact shaped like a dome and bonded to a lower face of one of said first movable contacts concentrically and bowing downward upon being depressed; and wherein said one of said first movable contacts is positioned at an intersection of said row of said first movable contacts and said column of said first movable contacts so as to be arranged for enter operations.

11. The movable contact arrangement of claim 10, wherein said second movable contact and said one of said first movable contacts are bonded together with an adhesive layer made of acrylic-based adhesive.

12. The movable contact arrangement of claim 10, wherein said second movable contact and said one of said first movable contacts are bonded together with a ring-shaped adhesive layer.

13. The movable contact arrangement of claim 12, wherein said ring-shaped adhesive layer is disposed on an upper face of said second movable contact and on said lower face of said one of said first movable contacts.

14. The movable contact arrangement of claim 13, wherein no adhesive layer is disposed at a center of said upper face of said second movable contact.

15. The movable contact arrangement of claim 12, wherein no adhesive layer is disposed at a center of an upper face of said second movable contact.

16. The movable contact arrangement of claim 10, wherein said second movable contact is formed of a conductive thin metal plate.

17. The movable contact arrangement of claim 10, wherein said first insulating film and said first adhesive layer extend outwardly beyond a periphery of said one of said first movable contacts.

18. The movable contact arrangement of claim 10, wherein said first insulating film and said first adhesive layer are each of a size so as to cover all of said plurality of said first movable contacts.

19. A method of manufacturing a movable contact arrangement that comprises:

a first insulating film, and a first adhesive layer disposed underneath a lower face of the first insulating film;

a plurality of first movable contacts shaped like domes and bonded onto the first adhesive layer and bowing downward upon being depressed, the first movable contacts being positioned so as to be spaced apart from each other and arranged in a cross shape in which a row of the first movable contacts intersects with a column of the first movable contacts;

a second movable contact shaped like a dome and disposed on a lower face of one of the first movable contacts concentrically and bowing downward upon being depressed, wherein the second movable contact and the one of the first movable contacts are bonded together with a ring-shaped adhesive layer, and wherein the one of the first movable contacts is positioned at an intersection of the row of the first movable contacts and the column of the first movable contacts so as to be arranged for enter operations, the method of manufacturing the movable contact arrangement comprising:

(a) transcribing a ring-shaped adhesive layer onto an upper face of the second movable contact concentrically; and (b) bonding the second movable contact having the ring-shaped adhesive layer concentrically to the lower face of the first movable contact by using the ring-shaped adhesive layer.

20. The method of manufacturing the movable contact arrangement of claim 19, wherein each of the first movable contacts is formed of a conductive thin metal plate.

21. The method of manufacturing the movable contact arrangement of claim 20, wherein the second movable contact is formed of a conductive thin metal plate.

22. The method of manufacturing the movable contact arrangement of claim 19, wherein no adhesive layer is disposed at a center of the upper face of the second movable contact.

23. The method of manufacturing the movable contact arrangement of claim 19, wherein said first insulating film and said first adhesive layer extend outwardly beyond a periphery of said one of said first movable contacts.

* * * * *